US006216315B1

(12) United States Patent
Fuzzell

(10) Patent No.: US 6,216,315 B1
(45) Date of Patent: Apr. 17, 2001

(54) FLOOR COVERING ANCHOR

(76) Inventor: Joe E. Fuzzell, 1013 Lake Way Dr., Niceville, FL (US) 32578

( * ) Notice: Subject to any disclaimer, the term of this patent is extended or adjusted under 35 U.S.C. 154(b) by 0 days.

(21) Appl. No.: 09/343,959

(22) Filed: Jun. 30, 1999

(51) Int. Cl.[7] ..... A47G 27/04
(52) U.S. Cl. ..... 16/17.1; 16/16; 16/8; 24/306
(58) Field of Search ..... 16/4, 6, 8, 10, 16/17.1; 24/306, 442

(56) References Cited

U.S. PATENT DOCUMENTS

| | | | | |
|---|---|---|---|---|
| 833,571 | * | 10/1906 | Bailey | 16/17.1 |
| 3,579,707 | * | 5/1971 | Whistler | 16/8 |
| 4,769,895 | * | 9/1988 | Parkins | 24/306 X |
| 4,998,319 | * | 3/1991 | Ford | 16/8 |
| 5,518,795 | * | 5/1996 | Kennedy et al. | 24/306 X |
| 5,761,765 | | 6/1998 | Fuzzell . | |
| 5,800,644 | * | 9/1998 | Covert | 16/16 X |
| 5,958,540 | * | 9/1999 | Berard et al. | 16/16 X |

* cited by examiner

*Primary Examiner*—Robert J. Sandy
(74) *Attorney, Agent, or Firm*—Peter Loffler

(57) ABSTRACT

A floor covering anchor is used to secure a rug to a runner or other desired object and has a plate member that has a plurality of upwardly extending fingers, each finger being configured to have either a relatively releasable grip or a relatively secure grip. A first adhesive portion, which may have a double tack configuration, is disposed on the top surface of the plate while a second adhesive portion, which may also have a double tack configuration, is disposed on the bottom surface. An optional plurality of fingers extends downwardly from the plate. Spacers can be used with the device for relatively thin rugs.

18 Claims, 5 Drawing Sheets

FLOOR COVERING ANCHOR

BACKGROUND OF THE INVENTION

1. Field of the Invention

The present invention relates to an anchor for anchoring a rug to a runner or other desired surface.

2. Background of the Prior Art

The need to anchor a rug or carpet to a runner or other desired surface is well known. Having the rug or runner secure and relatively movement free is the goal of anchoring devices. Many anchoring devices have been proposed in the art but most such devices suffer from one or more drawbacks. Many prior art devices are unduly complex making them expensive to manufacture and difficult to use. Some prior art devices have only limited effectiveness in a variety of settings while some devices have a relatively short life cycle.

Therefore, there is a need in the art for a floor covering anchor that overcomes the above-stated drawbacks. Such a floor covering anchor must be of relatively simple and straightforward design and must be easy to use. The device must be effective in various situations and must not have an unduly short life cycle. The device must not create a raised area in the floor covering that can cause localized wear or that can cause a person to trip and fall.

SUMMARY OF THE INVENTION

The floor covering anchor of the present invention addresses the aforementioned needs in the art. The floor covering anchor is a relatively simple and straightforward device that secures a rug to a runner or other desired surface, such as a pad, a floor, a wall, etc., with relative ease. The device is simple in design and does not have an unduly short life cycle. The floor covering anchor allows either a relatively releasable grip of the device to its target object or a relatively secure grip.

The floor covering anchor of the present invention is comprised of a generally flat first plate having a top surface and a bottom surface, and a plurality of first fingers extending upwardly from the top surface. A first adhesive portion, which may be double tack tape, is disposed on the top surface while a second adhesive portion, which may also be double tack tape, is disposed on the bottom surface. The plurality of first fingers along with the first adhesive portion grip the rug while the second adhesive portion attaches the device to a target object. If desired, an optional plurality of second fingers extend downwardly from the bottom surface for added grip strength. Each of the plurality of first fingers and second fingers have a base that has a pair of sides and an arrowhead. The base of the arrowhead meets each of the sides at an angle that is at least about 90 degrees to provide the device with a relatively releasable grip or at an angle that is less than about 90 degrees for a relatively secure grip. A second plate can be provided with at least one opening, each adapted to receive a respective one of the plurality of first fingers. This second plate can be fitted over the first plate to act as a spacer for relatively thin rug applications. A spacer may also be used for the second set of fingers Alternately, the floor covering anchor of the present invention can be comprised of a generally flat plate having a top surface and a bottom surface, a plurality of first fingers extending upwardly from the first top surface, and a plurality of second fingers extending downwardly from the bottom surface. Each set of fingers can be configured for either type of grip. As a further alternative, the second adhesive portion can be replaced by at least one portion of cooperating hook and loop material with a corresponding portion of hook and loop material located on the target surface for rug attachment.

BRIEF DESCRIPTION OF THE DRAWINGS

Similar reference numerals refer to similar parts throughout the several views of the drawings.

DESCRIPTION OF THE PREFERRED EMBODIMENT

Figure 5:
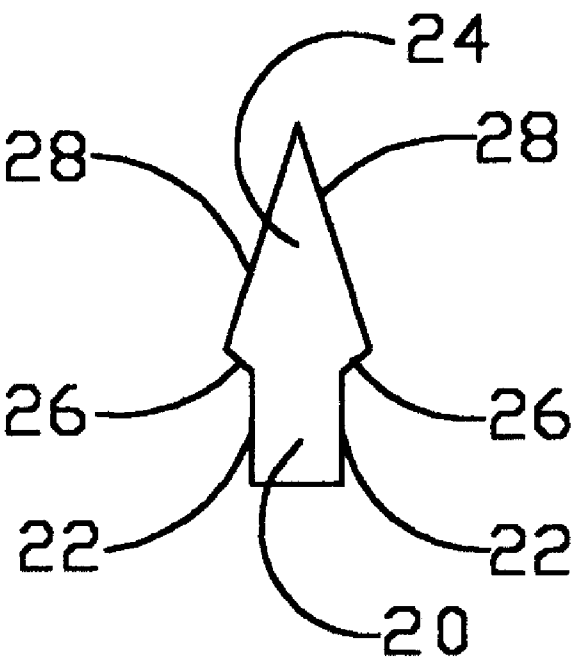
FIG. 5 is a side elevation of a second type of finger that can be used with the floor covering anchor of the present invention.
Figure 4:
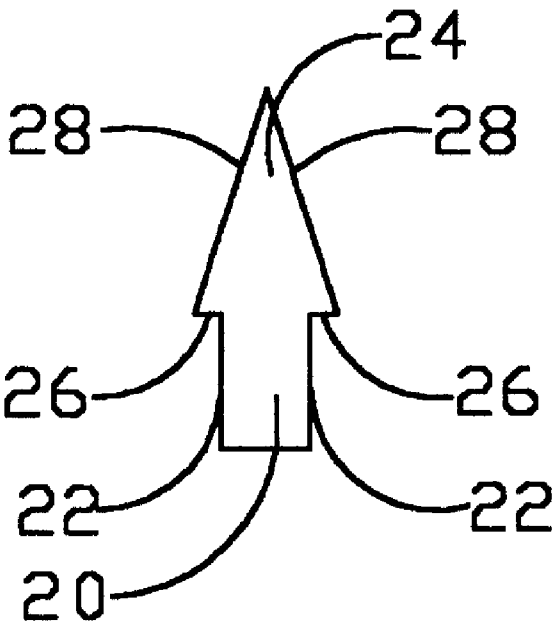
FIG. 4 is a side elevation of a first type of finger that can be used with the floor covering anchor of the present invention.
Figure 7:
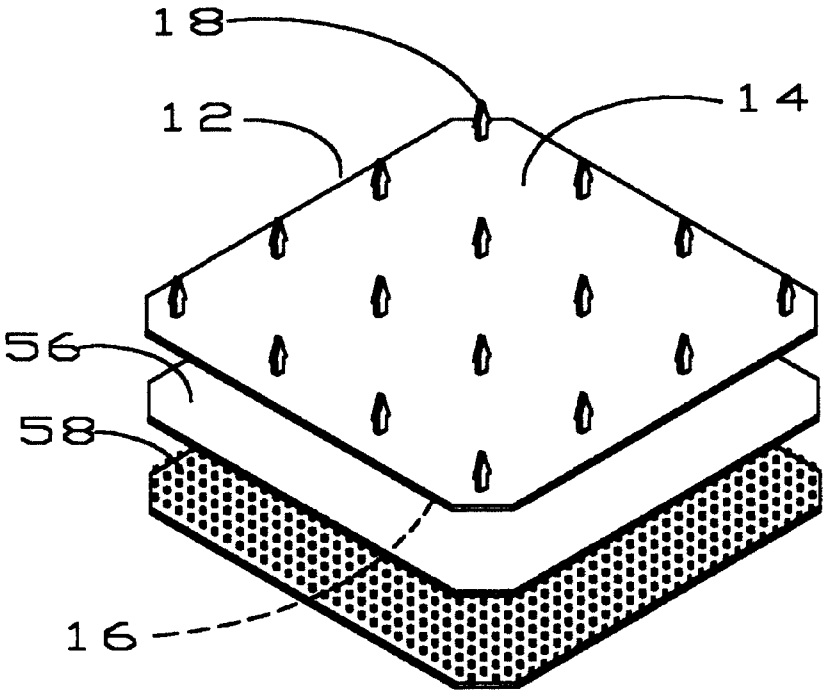
FIG. 7 is a perspective view of a second alternate embodiment of the floor covering anchor of the present invention.
Figure 6:
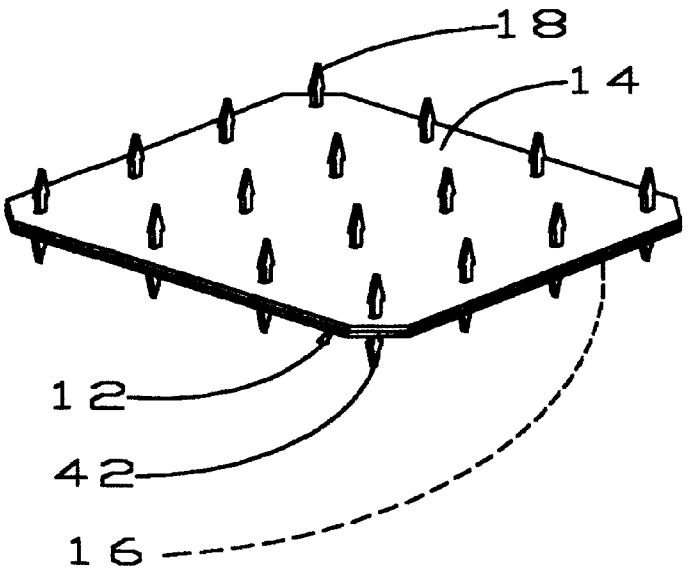
FIG. 6 is a perspective view of an alternate embodiment of the floor covering anchor of the present invention.

Referring now to the drawings, it is seen that the floor covering anchor of the present invention, generally denoted by reference numeral 10, is comprised of a first plate 12 that has a first top surface 14 and a first bottom surface 16. A plurality of first fingers 18 extend upwardly from the top surface 14. As seen in FIGS. 4 and 5, each of the first fingers 18 can be of one of two types. Each finger 18 has a base 20 with a pair of first sides 22 and an arrowhead 24 attached to the base 20, the arrowhead 24 having a second pair of sides 26 that each attach to a respective one of the first pair of sides 22 and a third pair of sides 28 that each attach to a respective one of the second pair of sides 26 and that meet at a point. As seen in FIG. 4, each of the first pair of sides 22 attaches to its respective second side 26 at an angle that is no greater than about 90 degrees. This finger configuration allows the finger 18 to penetrate through a surface via the point yet be relatively difficult to retract therefrom due to the angle formed between each first side 22 and its respective second side 26 which causes each second side 26 to provide retraction resistance. This configuration provides a relatively secure grip. As seen in FIG. 5, each of the first pair of sides 22 attaches to its respective second side 26 at an angle that is at least about 90 degrees. This finger configuration allows the finger to penetrate through a surface via the point thereafter be relatively easy to retract therefrom as the angle formed between each first side 22 and its respective second side 26 is such that the second sides 26 does not provide sufficient resistance to retraction. This configuration provides a relatively releasable grip. The selection on the particular type of finger configuration is application specific.

A first adhesive portion 30 has a second top surface 32 and a second bottom surface 34 and is attached to the first top surface 14 of the first plate 12, such that the second bottom surface 34 faces the first top surface 14. The first adhesive portion 30 can be of a double tack configuration wherein the tack strength of the second top surface 32 is greater than the tack strength of the second bottom surface 34. The first adhesive portion 30 can be formed with a plurality of openings to allow the plurality of first fingers 18 to pass therethrough, or the first fingers 18 can penetrate through the first adhesive portion 30 thereby forming the required openings. A second adhesive portion 36 has a third top surface 38 and a third bottom surface 40 and is attached to the first bottom surface 16 of the first plate 12, such that the third top surface 38 faces the first bottom surface 16. The second adhesive portion 36 can also be of a double tack configuration wherein the tack strength of the third top surface 38 is greater than the tack strength of the third bottom surface 40.

In order to use the floor covering anchor 10 of the present invention, the floor covering anchor is engaged with one of its target objects (such as a rug R or a pad P) so that the first fingers 18 on the top surface 14 penetrate into this target object. Thereafter, the floor covering anchor 10 engages the other target object (such as a pad P or a floor F) so that the third bottom surface 40 adhesively engages this second target object. The two target objects are now secured to one another. The tack configuration of the two adhesive portions 30 and 36 assures a very strong grip of the device 10 to the first target object with a relatively weaker grip on the second target object in order to allow relatively easy removal of the device-laden first target object. If a more secure grip of the device 10 to the second target object is desired, a plurality of second fingers 42 are provided and extend downwardly from the first bottom surface 16. These fingers 42 can also have either a relatively releasable configuration or a relatively secure configuration.

Figure 2:
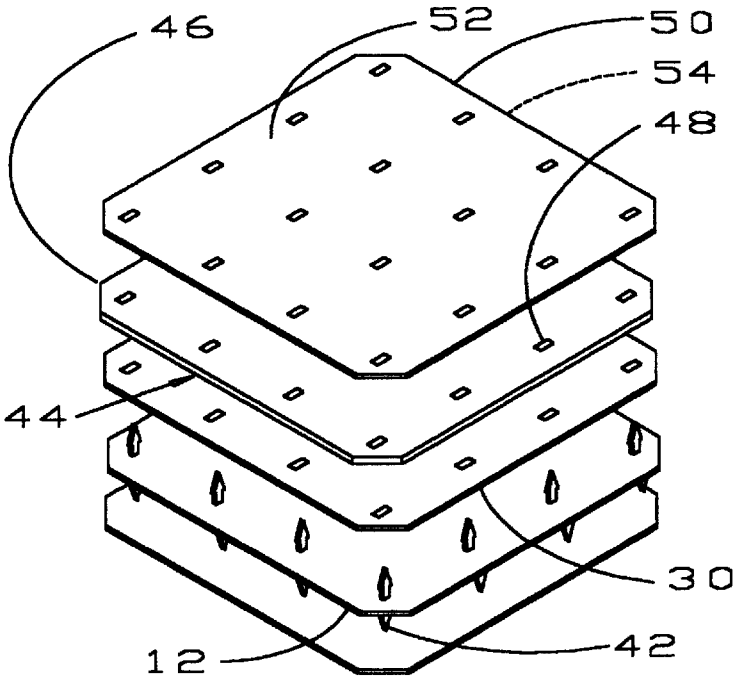
FIG. 2 is a perspective view of the floor covering anchor utilizing a spacer.
Figure 1:
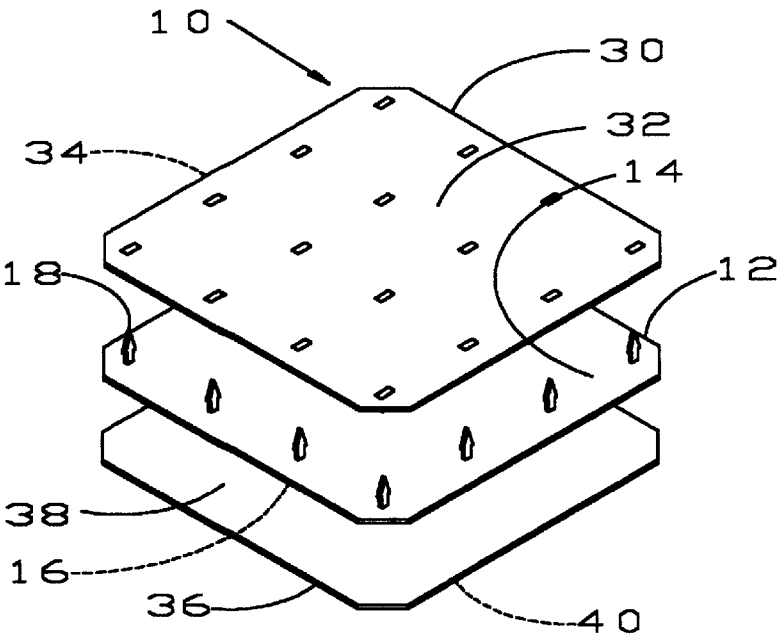
FIG. 1 is a perspective view of the floor covering anchor of the present invention.
Figure 3:
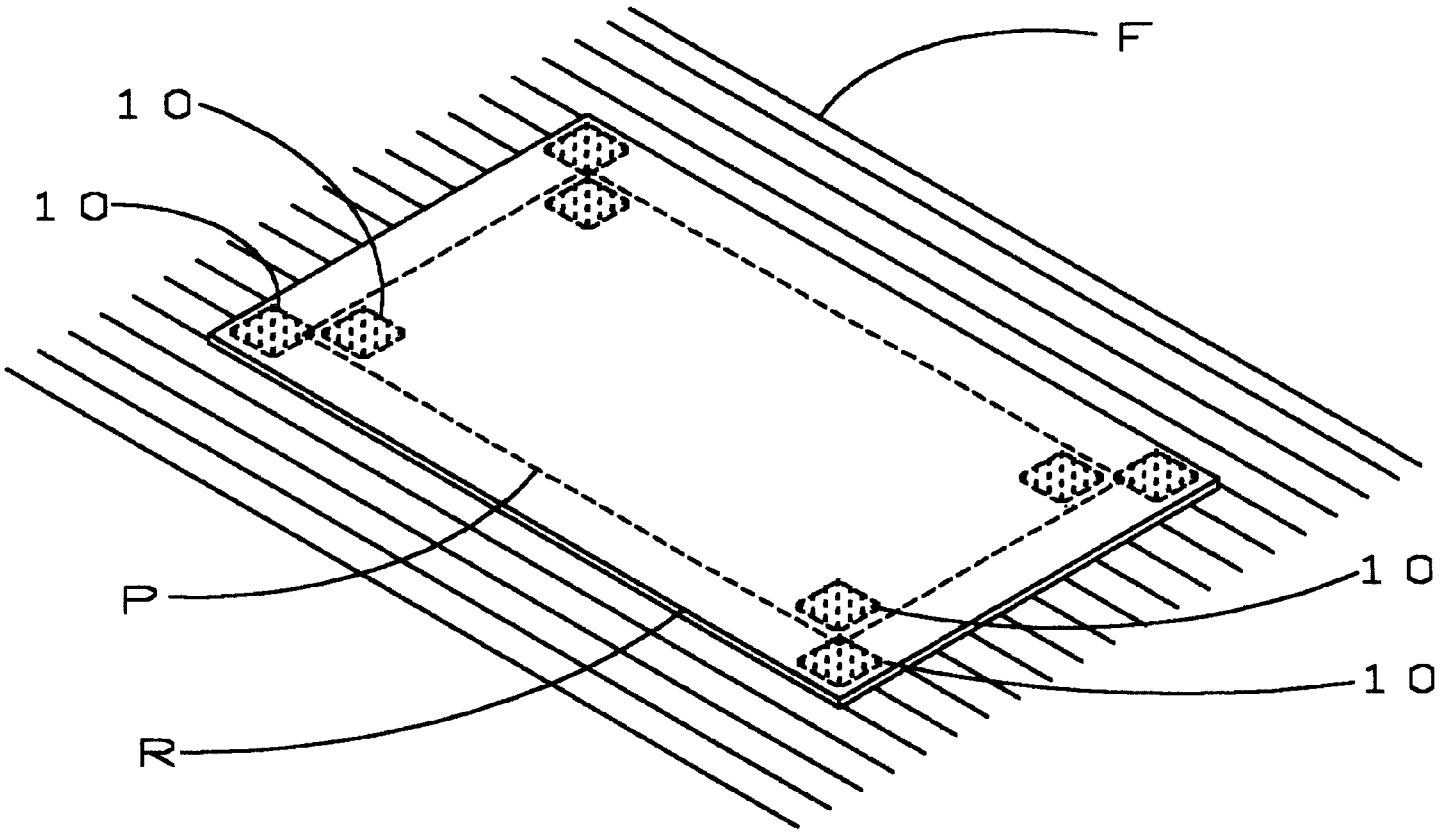
FIG. 3 is a perspective view of the floor covering anchor securing a rug to a pad and the rug to a floor surface.

If needed, one or more spacers 44 can be utilized with the floor covering anchor 10. As seen, in FIG. 2, each spacer 44 is comprised of a second plate 46 that has a plurality of openings 48 disposed thereon, each opening 48 corresponding to a respective one of the first fingers 18 or second fingers 42, and each being sized to allow the finger 18 or 42 to pass therethrough. The spacer 44 is positioned over the desired fingers 18 or 42 and pushed thereon to until the second plate 46 abuts the first plate 12. A third adhesive portion 50, which has a fourth top surface 52 and a fourth bottom surface 54 and is attached to the exposed surface of the spacer 44. The third adhesive portion 50 can be of a double tack configuration wherein the tack strength of the fourth top surface 52 is greater than the tack strength of the fourth bottom surface 54. Once the desired number of spacers 44 are in place, the floor covering anchor 10 is attached to the target objects.

In an alternate embodiment of the floor covering anchor 10, the first plate 12 has a plurality of first fingers 18 extending upwardly from the first top surface 14 and a plurality of second fingers 42 extending downwardly from the first bottom surface 16. In this embodiment, the fingers 18 and 42 provide all of the gripping of the target objects. As a further alternative, the second adhesive portion can be replaced with at least one portion of cooperating hook and loop material 56 that is attached to the first bottom surface 16 with a corresponding portion of hook and loop material 58 attached to one of the target objects. In such an embodiment, the first plate 12 is attached to one of the target objects in normal fashion, the second portion of hook and loop material 58 attached to the other target object, and the first plate 12 attached to the second target object such that the two portions of hook and loop material 56 and 58 mate.

Figure 8:
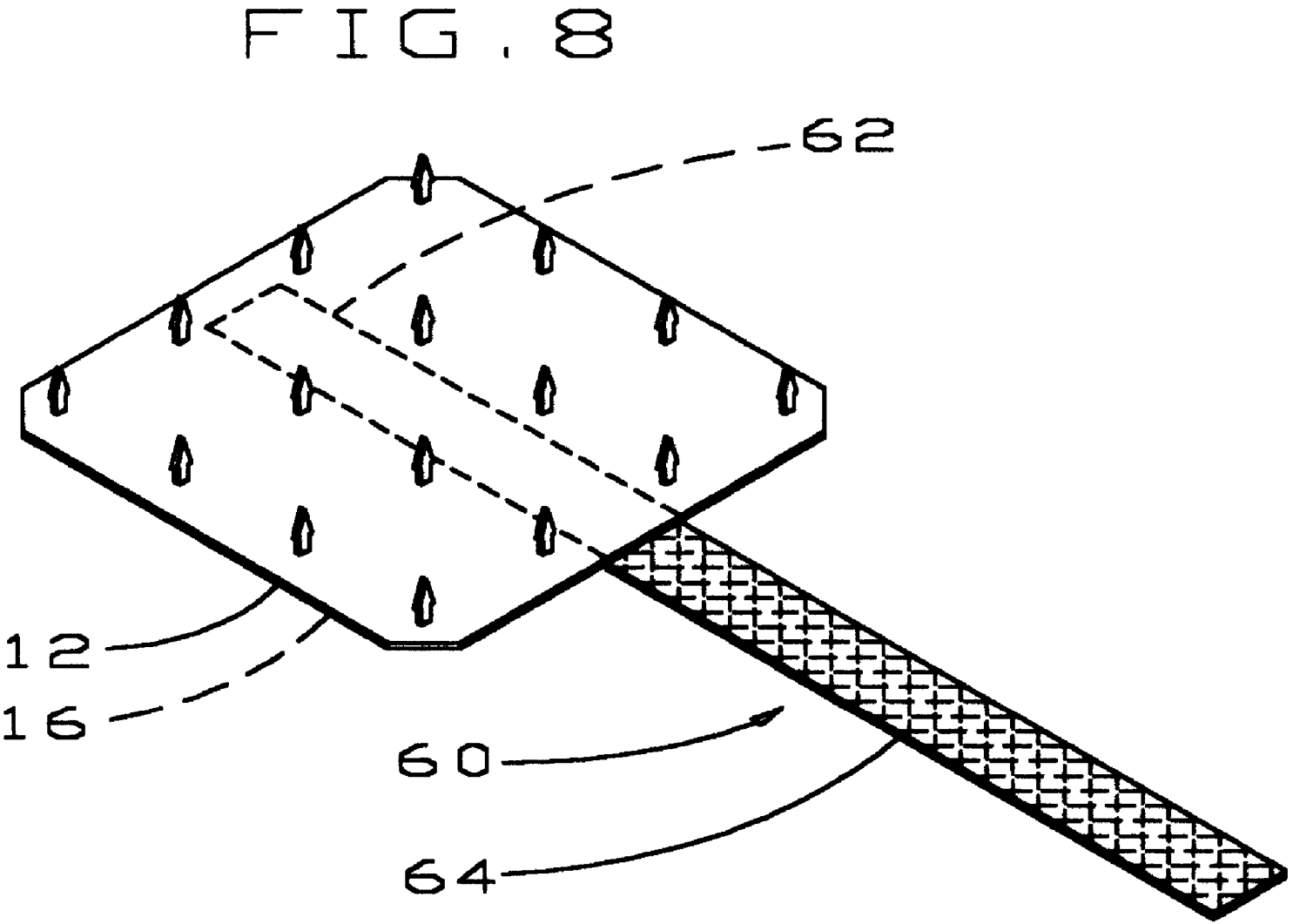
FIG. 8 is a perspective view of the release strap used with the floor covering anchor of the present invention.

As seen in FIG. 8, a strap 60 has a first end 62 attached to the bottom surface 16 of the first plate 12 and a second end 64. The strap 60 can be made of any appropriate material. The user can pull on the strap 60 in order to break the bond between the floor covering anchor 10 and the surface to which it is attached with a peeling action and requiring the minimum amount of force to break the bond. Such removal does not affect the bond between the floor covering anchor 10 and the floor covering to which it is attached.

While the invention has been particularly shown and described with reference to embodiments thereof, it will be appreciated by those skilled in the art that various changes in form and detail may be made without departing from the spirit and scope of the invention.

I claim:

1. A floor covering anchor comprising:

a generally flat first plate having a first top surface and a first bottom surface;

a plurality of first fingers extending upwardly from the first top surface;

a first adhesive portion having a second top surface with a first tack strength and a second bottom surface having a second tack strength, the second bottom surface mated to the first top surface; and a second adhesive portion having a third top surface with a third tack strength and a third bottom surface having a fourth tack strength, the third bottom surface mated to the first bottom surface.

2. The floor covering anchor as in claim 1 wherein the first tack strength is different than the second tack strength.

3. The floor covering anchor as in claim 1 wherein the third tack strength is different than the fourth tack strength.

4. The floor covering anchor as in claim 1 wherein the first tack strength is different than the second tack strength and the third tack strength is different than the fourth tack strength.

5. The floor covering anchor as in claim 1 wherein each of the plurality of first fingers has a first base having a pair of first sides, and a first arrowhead having a pair of second sides each extending from a respective one of the pair of first sides, and a pair of third sides each extending from a respective one of the pair of second sides and meeting at a first point.

6. The floor covering anchor as in claim 5 wherein each of the first pair of sides joins its respective second side at an angle that is less than 90 degrees.

7. The floor covering anchor as in claim 5 wherein each of the first pair of sides joins its respective second side at an angle that is at least 90 degrees.

8. The floor covering anchor as in claim 1 further comprising a plurality of second fingers extending downwardly from the first bottom surface.

9. The floor covering anchor as in claim 8 wherein each of the plurality of second fingers has a second base having a pair of fourth sides, and a second arrowhead having a pair of fifth sides each extending from a respective one of the pair of fourth sides, and a pair of sixth sides each extending from a respective one of the pair of fifth sides and meeting at a second point.

10. The floor covering anchor as in claim 9 wherein each of the fourth pair of sides joins its respective fifth side at an angle that is less than 90 degrees.

11. The floor covering anchor as in claim 9 wherein each of the fourth pair of sides joins its respective fifth side at an angle that is at least 90 degrees.

12. The floor covering anchor as in claim 9 further comprising a second plate, the second plate having at least one opening, each of the at least one opening adapted to receive a respective one of the plurality of second fingers.

13. The floor covering anchor as in claim 1 further comprising a second plate, the second plate having at least one opening, each of the at least one opening adapted to receive a respective one of the plurality of first fingers.

14. The floor covering anchor as in claim 1 further comprising a strap having a first end disposed between the first bottom surface and the third bottom surface and a second end.

15. A floor covering anchor comprising:

a generally flat first plate having a top surface and a bottom surface;

a plurality of fingers having an arrowhead, the fingers extending upwardly from the top surface;

at least one portion of cooperating hook and loop material attached to the bottom surface;

and a strap having a first end, disposed between the bottom surface and at least one of the at least one portion of cooperating hook and loop material, and a second end.

16. The floor covering anchor as in claim 15 wherein each of the plurality of fingers has a base having a pair of first sides, and the arrowhead having a pair of second sides each extending from a respective one of the pair of first sides, and a pair of third sides each extending from a respective one of the pair of second sides and meeting at a first point wherein each of the first pair of sides joins its respective second side at an angle that is less than 90 degrees.

17. The floor covering anchor as in claim 15 wherein each of the plurality of fingers has a base having a pair of first sides, and the arrowhead having a pair of second sides each extending from a respective one of the pair of first sides, and a pair of third sides each extending from a respective one of the pair of second sides and meeting at a first point wherein each of the first pair of sides joins its respective second side at an angle that is at least 90 degrees.

18. The floor covering anchor as in claim 15 further comprising a second plate, the second plate having at least one opening, each of the at least one opening adapted to receive a respective one of the plurality of fingers.

* * * * *